United States Patent [19]

Clarke et al.

[11] Patent Number: 4,611,875

[45] Date of Patent: Sep. 16, 1986

[54] COMMUNICATION SYSTEM CROSS-CONNECT FIELD POWER ADAPTER

[75] Inventors: John E. Clarke, Colts Neck, N.J.; Edwin C. Hardesty, Perry Hall, Md.; George W. Reichard, Jr., Carmel, Ind.

[73] Assignees: AT&T Information Systems, Holmdel; AT&T Technologies, Berkeley Heights, both of N.J.

[21] Appl. No.: 643,446

[22] Filed: Aug. 23, 1984

[51] Int. Cl.[4] ..... H01R 13/50

[52] U.S. Cl. ..... 339/154 A; 339/176 M

[58] Field of Search ..... 339/154–159, 339/166, 107, 97 R, 97 P, 176 R, 176 M; 179/178, 179

[56] References Cited

U.S. PATENT DOCUMENTS

| | | | |
|---|---|---|---|
| 2,316,072 | 4/1943 | Judisch | 339/166 |
| 3,990,763 | 11/1976 | Kress | 339/155 R |
| 4,241,974 | 12/1980 | Hardesty | 339/154 A |
| 4,295,702 | 10/1981 | Snyder | 339/154 R |
| 4,403,821 | 9/1983 | Zimmerman et al. | 339/107 |
| 4,438,998 | 3/1984 | Myers | 339/154 A |
| 4,462,656 | 7/1984 | Beyer | 339/154 A |
| 4,477,141 | 10/1984 | Hardesty | 339/156 R |

FOREIGN PATENT DOCUMENTS

| | | | |
|---|---|---|---|
| 175137 | 4/1935 | Switzerland | 339/166 R |

*Primary Examiner*—Gil Weidenfeld
*Assistant Examiner*—David L. Pirlot
*Attorney, Agent, or Firm*—David H. Tannenbaum

[57] ABSTRACT

A power adapter is disclosed for use in connecting electrical power to a telephone station via a cross-connect jack. The power adapter has a plug-end for mating with the cross-connect field and a jack-end for receiving a cross-connect patch cord. The power adapter includes a two-conductor permanently attached power cord. Bent wire technology is used to connect the contacts of the receiving jack with the contacts of the plug while blade insertion technology is used for making contact with the ends of the power conductors.

6 Claims, 7 Drawing Figures

COMMUNICATION SYSTEM CROSS-CONNECT FIELD POWER ADAPTER

BACKGROUND OF THE INVENTION

This invention relates to an arrangement for providing power to telephone stations and more particularly to such an arrangement where the power is provided via a cross-connect field power adapter plug/jack.

Certain telephone communication systems available today utilize an easily rearrangeable cross-connect field whereby the customer, or a craftsperson, can connect on a semi-permanent basis any trunk circuit with any telephone station. An example of such an arrangement is shown in a U.S. patent application Ser. No. 578,634, filed on Feb. 9, 1984, in the name of Baker et al, which application is hereby incorporated by reference herein. In the Baker system it is contemplated that the cross connections will be made using a number of universal plug-ended cords, one end of which would be inserted into the jack position corresponding to the desired trunk and the other end plugged into the jack position of the desired station.

One problem with such a system is that when it is desired to provide power to the telephone station from a central source over the telephone leads, one of the plug-ended cords must be broken into in order to insert the power. One suggestion would be to make a triple-ended cord with one end terminating at the line jack position, one end terminating at the station jack position and the third end terminating at the power take-off point. This solution would require either that a splice be made in the cord at some point or that two cords be inserted into one of the plug ends. Splices are unacceptable for many reasons, primarily because of safety and structural integrity and inserting two cords into a plug end is physically impossible without a major redesign of the plug. In addition, using a three-ended cord would require the removal of the original double-ended cord thereby adding complexity to an otherwise simple task.

One requirement for any redesign of the plug is that the "new" plug must have the same width as the old one and must not inhibit stacking in adjacent lateral or vertical cross-connect jack positions. For application in the Baker et al, cross-connect field, vertical spacing becomes critical.

SUMMARY OF THE INVENTION

We have designed a power adapter plug/jack which is designed to be plugged into the telephone jack positions of a cross-connect field and which has a front plug having eight terminals and a rear jack adapted to receive the standard six terminal cross-connect cord plug. The power adapter has a two conductor cord permanently attached which serves to supply power to two of the eight terminals of the front jack with the other six terminals being connectable to the six terminal cross-connect cord plug. The other end of the two conductor cord terminates in a connector adapted for mating with the power take-off position.

The plug/jack adapter combines two types of technology to connect the plug, the jack and the power cord. Bent wire technology is used to provide electrical continuity between the six position rear jack and the center six positions of the eight position front plug. Electrical continuity between the two conductor power cord and positions one and eight of the front plug is made using blade insertion technology. The two conductors are inserted from the rear into molded-in channels along the bottom surface of the plug/jack and are pushed in until they emerge from the front of the plug. Individual metal blades are then pushed into each wire, thereby securing the wire ends and providing electric contacts for supplying the power to the station.

BRIEF DESCRIPTION OF THE DRAWING

These and other objects and features, together with the operation and utilization of the present invention, will be more apparent from the illustrative embodiment shown in conjunction with the drawing in which.

DETRAILED DESCRIPTION

Figure 1:
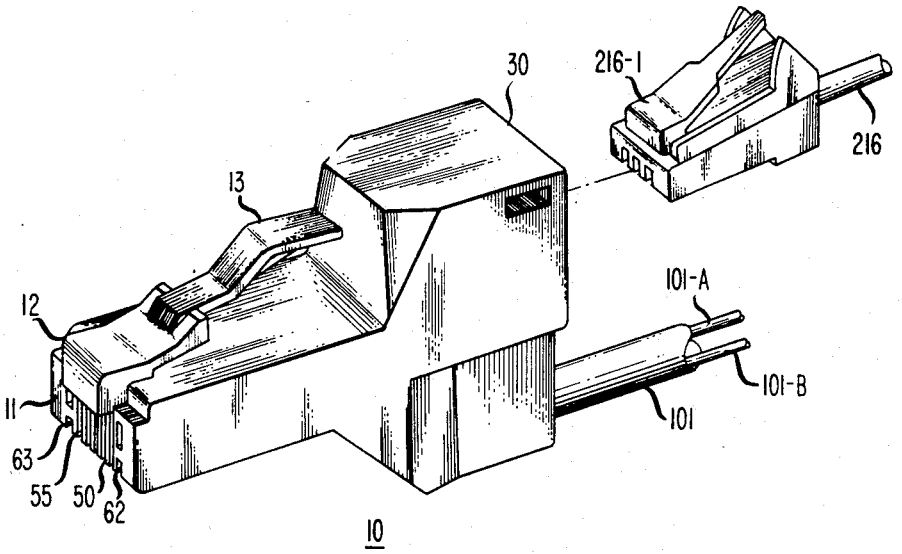
FIG. 1 is a perspective view of the cross-connect power adapter.

FIG. 1 shows a perspective view of power adapter 10 where front plug-end 11 is adapted for mating with any jack of a cross-connect field in the manner to be discussed. Opposite the plug-end of power adapter 10 there is a jack-end 30 adapted to receive the plug-end 216-1 of double plug-ended cross-connect cord 102.

Cable 101 extends from adapter 10 at a position below jack 30. Within cable 101 there are at least two conductors 101A and 101B which, as will be seen, extend through the body of adapter 10 and terminate at contacts 63 and 62, respectively, at the plug-end of the adapter. Also, as will be seen, the six contacts of cross-connect cord plug 216-1 mate with six contacts within jack 30 which contacts extend through the body of adapter 10 terminating as contacts 50–55 at the plug-end 11 of adapter 10.

Before continuing our discussion, it may be helpful to review one context in which adapter 10 can be advantageously utilized. This can be seen in FIG. 2 where central office trunks T1–TN are shown terminating at network interface 210 where the individual trunks are combined into multi-conductor cables which are in turn connected to PBX 211. Line 212 from PBX 211 are plugged into cross-connect field 215 and are in turn connected to individual jack sets 20, 21. Lines L1–LN from each telephone station set S1–SN are also plugged into cross-connect field 215 using different jack sets 22, 23 for termination.

Figure 2:
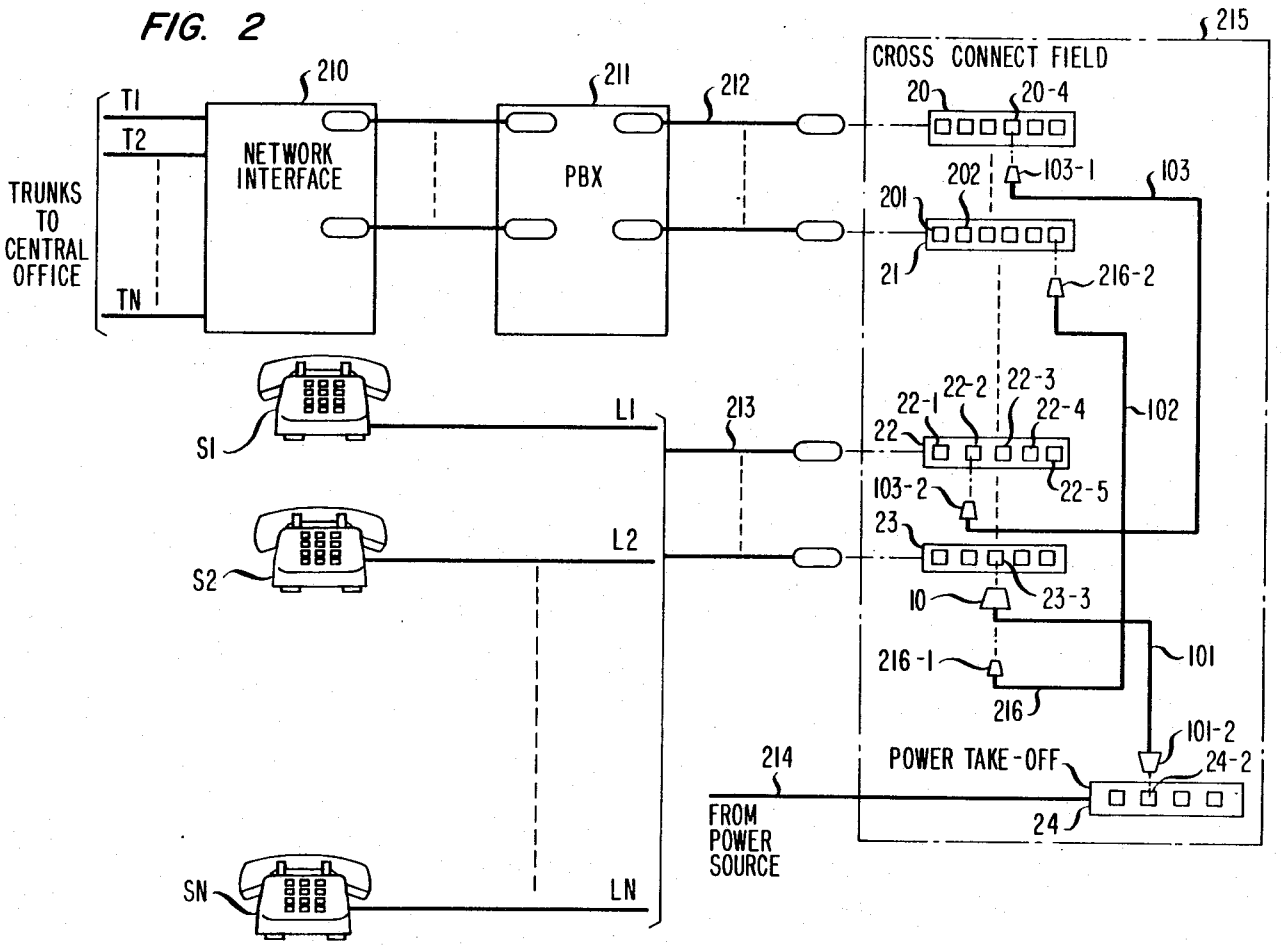
FIG. 2 is a schematic representation showing one environment in which the adapter can be utilized.

Each cable 212, 213 is connected to a particular jack set 20, 21, 22 and 23 and the cable pairs within the cable are connected to individual jacks. For example, in multiples of eight, the conductors of cable 213 are connected to jacks 22-1, 22-2, 22-3, 22-4 and 22-5. A six conductor double plug-ended patch cord, such as patch cord 216 or 103, is then used to interconnect any jack associated with a station line with any jack associated with a PBX line. As shown in FIG. 2, station jack 22-2 is cross-connected to trunk jack 20-4 via double-ended cord 103. The user then, by simply changing one end of the patch cord, may change the association between any PBX (or CO) line and the station.

When it is desired to add power to a telephone station, adapter 10 would be inserted in the connection associated with the station, for example, between the plug-end 216-1 of cross-connect cord 216 and cross-connect jack 23-3. The plug-end of adapter 10 would then be inserted into jack 23-3 and plug 216-1 would be inserted into the jack-end of adapter 10. Auxiliary cord 101 extending from adapter 10 would then be connected to the power take-off point, such as connector 24-2. This connection could be made using the same type of quick connect or any type of plug/jack combination.

A craftsperson using the power adapter would then not be required to make any splices and would be able to supply to any station simply by removing one plug (216-1) and reinserting the same plug into adapter 10. By using bright colors for the adapter, the craftsperson or customer can easily observe which ones of the telephone stations are obtaining auxiliary power at any given time.

Figure 3:
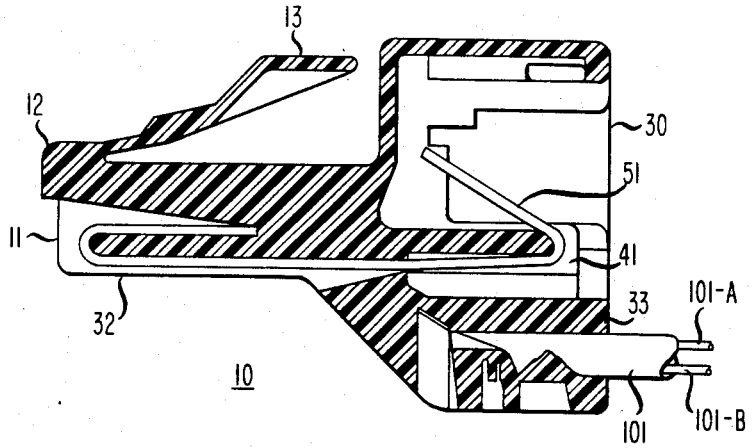
FIG. 3 is a sectional view of the power adapter taken through section 3—3 of FIG. 4.

Turning now to FIG. 3, it will be seen that within jack 30 there exists a number of parallel contacts, such as contacts 51, which are constructed from spring material and which extend from jack-end 30 of adapter 10 through the body of the adapter to plug-end 11. As will be seen, the bottom portion of plug-end 11 is open so that contact can be made with the contacts of a mating jack when plug-end 11 is inserted into the jack.

As can be seen from FIG. 3, cord 101 contains conductors 101A and 101B and is permanently mounted below jack-end 30 and retained by a crimping device. Conductors 101A and 101B, as will be seen, extend through the body of adapter 10 for termination at plug-end 11 in the same plane as and parallel to the spring contacts, such as contact 51.

Figure 4:
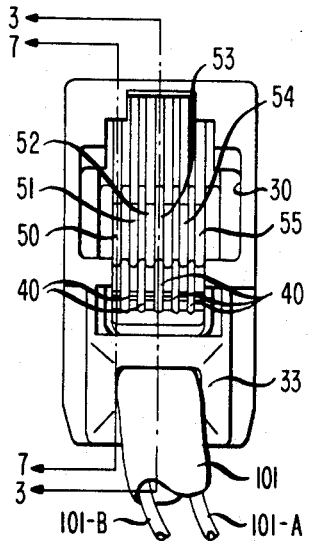
FIG. 4 is a view of the power adapter from the right (rear) side (in relation to FIG. 1)

Turning now to FIG. 4 and looking into jack 30, there can be seen six contacts 50–55 separated by insulated separators 40. As discussed above, these contacts are adapted for making electrical contact with the six contacts of the plug-end 216-1 of cross-connect cord 102 (shown in FIG. 1).

Figure 5:
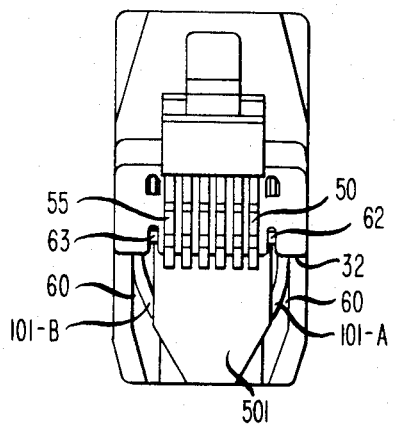
FIG. 5 is a left side (front) view of the power adapter (in relation to FIG. 1)

Turning now to FIG. 5 and looking at the adapter from plug-end 11, the six contacts 50–55 can be seen flanked on either end by contacts 62 and 63 which contacts, as will be seen, are electrically connected to one or the other of conductors 101A and 101B. These conductors 101A and 101B are presented to plug-end 11 via channels 60 from the far end of the connector.

Figure 6:
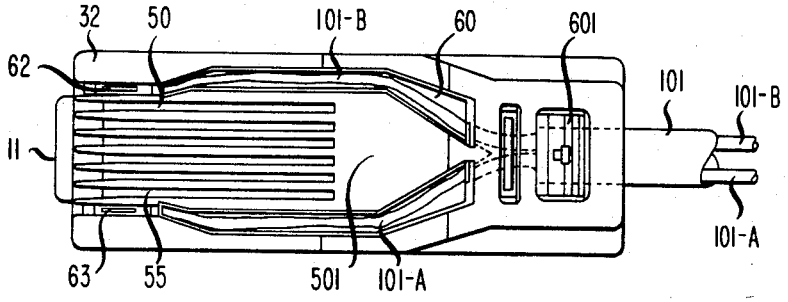
FIG. 6 is a bottom view of the power adapter.

Channels 60 can be seen more clearly in FIG. 6 which is a bottom view of adapter 10 showing cable 101 being held by crimping device 601. Conductors 101A and 101B extend from cable 101 and are separated by wedge 501 and forced via channels 60 up the ramp (FIG. 1) and to the outside of the six spring contacts 50–55. Blades 62 and 63 are inserted from plug-end 11 of adapter 10 and make electrical contact with the ends of conductors 101A and 101B. Thus, plug-end 11 of adapter 10 has a number of contacts n, in this case eight, for connection to the cross-connect field extending to the telephone station. This number n is greater, in this case 2 greater, than the number of contacts in jack-end 30.

Figure 7:
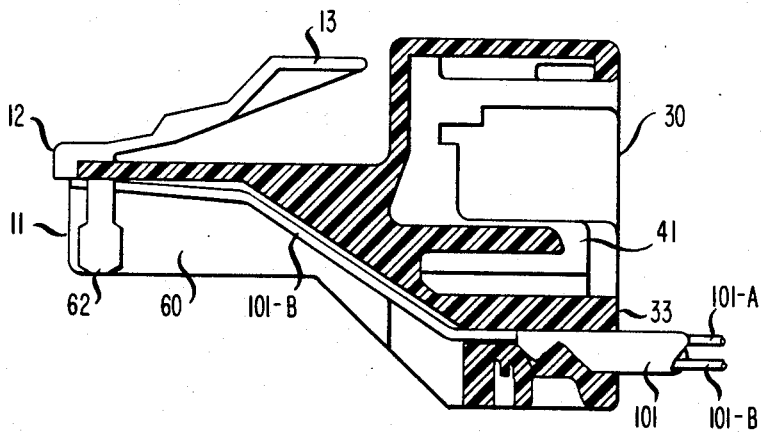
FIG. 7 is a sectional view taken through section 7—7 of FIG. 4.

FIG. 7 shows a sectional view of the adapter with wire 101B in its channel extended from cable 101 up to nose 11 at the front end of the adapter.

CONCLUSION

While a 2-conductor cord has been shown, it will be immediately obvious to anyone skilled in the art that there could be one, two or more conductors added to the basic contact set and, that by changing the channel pattern, these added conductors can be presented on the outside of the existing contacts or interspersed therewith either in the same plane or in different planes depending upon the desired application. It should also be obvious that the blade contacts could be any length desirable. It should also be obvious to one skilled in the art that while the discussion herein centered on a power adapter, the same concept can be used to add any auxiliary signal to the communication line.

What is claimed is:

1. An adapter for use in a communication system cross-connect field between the jack end of a communication path and the plug end of a cross-connect cord, said adapter arranged for connecting an auxiliary cord carrying specific signals having at least two conductors to said communication path so that said specific signals can be added to signals on said communication path without interference with said communication path signals, said adapter comprising a first end having a jack for mating with said plug of said cross-connect cord, said jack having a number of electrical contacts n equal to the number of electrical contacts of said cross-connect plug, a second end opposite said first end having a plug for mating with said jack end of said communication path connection, said plug having a number of electrical contacts greater than n for also mating with electrical contacts of said jack and of said communication path, means located at said first end and below said jack for accepting said auxiliary cord having multiconductors and for presenting said conductors of said auxiliary cord to said second end, said means including channels connecting said first end of said plug to said second end, each said channel formed to receive one of said conductors of said auxiliary cord, said second end having means for securing ones of said conductors presented from said first end via said channels, said securing means forming a portion of said contacts at said second end and said auxiliary cord conductors establishing a separate electrical path through said adapter for carrying said specific signals.

2. The invention set forth in claim 1 wherein n of said contacts at said second end other than said contacts formed by said securing means are electrically connected to n of said contacts at said first end by continuous bent springs extending through said adapter from said first end to said second end said springs forming said contacts at said first and second ends.

3. The invention set forth in claim 2 wherein said presenting means includes a wedge embedded within said adapter for separating said cord conductors for presentation to each of said channels.

4. The invention set forth in claim 3 wherein said securing means includes electrical contact blades inserted into slots in said second end.

5. The invention set forth in claim 4 wherein said second end contacts are mounted in parallel with each other and wherein said electrical contact blades are positioned on either end of said n spring contacts.

6. The method of adding auxiliary signals to a line terminated at a first cross-connect jack where the line is cross-connected to a second line via a cross-connect cord having a first plug for insertion in said first cross-connect jack, said method comprising removing said first plug from said first jack, inserting in said first jack an adapter having a plug end for mating with said first jack and having a jack for mating with said first plug and having a permanently affixed auxiliary cord, having a free end, said adapter arranged such that signals from said first plug pass through said adapter to certain contacts of said first jack and such that signals from said auxiliary cord also pass through said adapter separate from said first plug signals to other contacts of said first jack, inserting said first plug into said adapter jack, and connecting said free end of said auxiliary cord to a source of auxiliary signals.

* * * * *